US005304449A

United States Patent [19]

Hollenbaugh, Jr.

[11] Patent Number: 5,304,449

[45] Date of Patent: Apr. 19, 1994

[54] TONER AND DEVELOPER COMPOSITIONS WITH PYRIDINIUM COMPOUNDS AND TETRASUBSTITUTED AMMONIUM SALTS AS CHARGE ENHANCING ADDITIVES

[75] Inventor: William H. Hollenbaugh, Jr., Webster, N.Y.

[73] Assignee: Xerox Corporation, Stamford, Conn.

[21] Appl. No.: 983,192

[22] Filed: Nov. 30, 1992

[51] Int. Cl.[5] ..... G03G 9/08

[52] U.S. Cl. ..... 430/110; 430/120

[58] Field of Search ..... 430/110, 115, 120

[56] References Cited

U.S. PATENT DOCUMENTS

| | | | |
|---|---|---|---|
| 3,467,634 | 9/1969 | Jacknow et al. | 260/80.71 |
| 3,526,533 | 9/1970 | Jacknow et al. | 117/100 |
| 3,590,000 | 6/1971 | Palermiti et al. | 252/62.1 |
| 3,800,588 | 4/1974 | Larson et al. | 73/71.6 |
| 3,847,604 | 11/1974 | Hagenbach et al. | 96/15 D |
| 4,265,990 | 5/1981 | Stolka et al. | 430/54 |
| 4,298,672 | 11/1981 | Lu | 430/108 |
| 4,558,108 | 12/1985 | Alexandra et al. | 526/340 |
| 4,560,635 | 12/1985 | Hoffend et al. | 430/106.6 |
| 4,752,550 | 6/1988 | Barbetta et al. | 430/106.6 |
| 5,114,821 | 5/1992 | Haack | 430/110 |
| 5,151,338 | 9/1992 | Bayley et al. | 430/106 |
| 5,202,209 | 4/1993 | Winnik et al. | 430/110 |
| 5,212,035 | 5/1993 | Wilson et al. | 430/110 |

*Primary Examiner*—John Goodrow
*Attorney, Agent, or Firm*—Oliff & Berridge

[57] ABSTRACT

Toner and developer compositions contain as charge enhancing components (1) alkyl pyridinium compounds or their hydrates and (2) tetrasubstituted ammonium salts. These toner and developer compositions show improved $LC_{50}$ values and are environmentally friendly, and at the same time have very good electrical properties.

31 Claims, 4 Drawing Sheets

TONER AND DEVELOPER COMPOSITIONS WITH PYRIDINIUM COMPOUNDS AND TETRASUBSTITUTED AMMONIUM SALTS AS CHARGE ENHANCING ADDITIVES

BACKGROUND OF THE INVENTION

The present invention is directed to toners and developer compositions and methods of imaging. More specifically the present invention is directed to toner and developer compositions comprising a combination of charge enhancing additives which is environmentally friendly and has good electrical properties.

Many toner and developer compositions are currently employed in the xerographic art. However, a number of these compositions may pose an environmental hazard, especially to the aquatic environment. Alkyl pyridinium compounds, in particular pure cetyl pyridinium chloride (>99% pure), a component of many toner and developer compositions such as of an aluminum compound of 3,5 dialkyl salicylic acid/CPC containing 7% PV Fast Blue Pigment, 2% an aluminum compound of 3,5 dialkyl salicylic acid, 0.5% cetyl pyridinium chloride and 90.5% styrenebutadiene copolymer and those disclosed in U.S. Pat. Nos. 4,298,672; 5,114,821; 4,752,550 and 5,151,338, may result in undesirable levels in the environment. Such levels are believed to be related to the water extractable alkyl pyridinium level which is the amount of soluble alkyl pyridinium chloride removed from the toner when flushed with water.

Some states of the United States of America, such as California, impose strict regulations on the disposal of materials designated for landfill such as spent xerographic toners. Such materials must pass acute lethal evaluation tests to be classified as non-hazardous. Many current toners containing 2% cetyl pyridinium chloride (CPC) have a $LC_{50}$ (lethal concentration to 50% of a population) equal to about 68 mg/1 and may not meet the stringent levels now or soon to be required in some states as well as in some European countries. As a consequence, users of such toner may be confronted with inconvenient and costly waste disposal situations.

Furthermore, positively charged toner compositions having alkyl pyridinium charge enhancing additives are useful in electrostatographic imaging systems such as those which employ a Viton coated fuser roll; however such charge enhancing additives may react with polymers contained on the Viton fuser roll over time causing decomposition of the roll.

One such Viton fuser roll which may be used in electrostatographic copying machines is composed of a soft roll fabricated from lead oxide, du Pont Viton E-430 resin, and vinylidene fluoride hexafluoropropylene copolymer. Excellent image quality has been obtained with such Viton fuser rolls. However, it appears that certain specific charge control additives, such as tetrasubstituted ammonium salts, and alkyl pyridinium compounds, such as cetyl pyridinium chloride, react with the Viton of such Viton fuser rolls. For example, cetyl pyridinium chloride appears to be catalytically decomposed by the lead oxide contained in the fuser roll resulting in a highly unsaturated compound which polymerizes and condenses with the unsaturated Viton E-430 material. As a result, the Viton fuser roll turns black, develops multiple surface cracks, and the surface hardens resulting in image quality deterioration.

Toner compositions comprising the above described charge enhancing additives are useful for causing the development of images formed on layered photoresponsive imaging devices comprised of charge generating and charge transport layers. These devices are charged negatively, rather than positively as is usually the situation with selenium photoreceptors. Thus a toner composition which is positively charged is required in order that the toner particles can be suitably attracted to the electrostatic latent image contained on the photoreceptor surface. In view of this, efforts have been devoted to obtaining developer compositions containing toners which are positively charged. While many charge control additives are known for this purpose, there continues to be a need for new additives. Specifically, there continues to be a need for additives which will not interact with Viton type fuser rolls. Moreover, there continues to be a need for positively charged toner and developer compositions possessing rapid admix charging characteristics. This property allows uncharged toner to rapidly gain charge when introduced into a xerographic developer. Further, there continues to be a need for new charge enhancing additives which can be economically prepared. Additionally, there is a need for substantially non-toxic charge enhancing additives, and a need for charge enhancing additives which can be easily and permanently dispersed in toner resin particles. Also, there is a need for toner compositions with charge stability which can be desirably obtained by extrusion toner processing.

Attempts have been made to remedy such problems by employing toner compositions without alkyl pyridinium compounds such as toner and developer compositions containing mixtures of dimethyl distearyl ammonium methyl sulfate and dimethyl distearyl ammonium bisulfate and as described in U.S. Pat. No. 4,560,635; however sacrificing the advantages of employing alkyl pyridinium compounds. Alkyl pyridinium compounds provide for toners which have conductivities which remain at acceptable levels of greater than or equal to $10^{-12}$ ohm-cm throughout the life of the toner and over as broad a concentration range as possible, typically about 1–4% by weight. This characteristic is thought to be a unique characteristic of toners which contain alkyl pyridinium compounds, in particular halogenated alkyl pyridinium compounds. This is important since environmental conditions and normal toner variation result in tribo fluctuations and corresponding toner concentration fluctuations in xerographic machines.

There is a need for improved toner and developer compositions having the advantages, but not the disadvantages of toner and developer compositions containing alkyl pyridinium compounds.

SUMMARY OF THE INVENTION

The present invention is directed to toners comprising from about 0.35% to about 0.65% by weight of a pyridinium compound or its hydrate and from about 1% to about 2% by weight of a tetrasubstituted ammonium salt, optionally in conjunction with a carrier, and to a method of developing an image therewith.

DETAILED DESCRIPTION OF PREFERRED EMBODIMENTS

Figure 1:
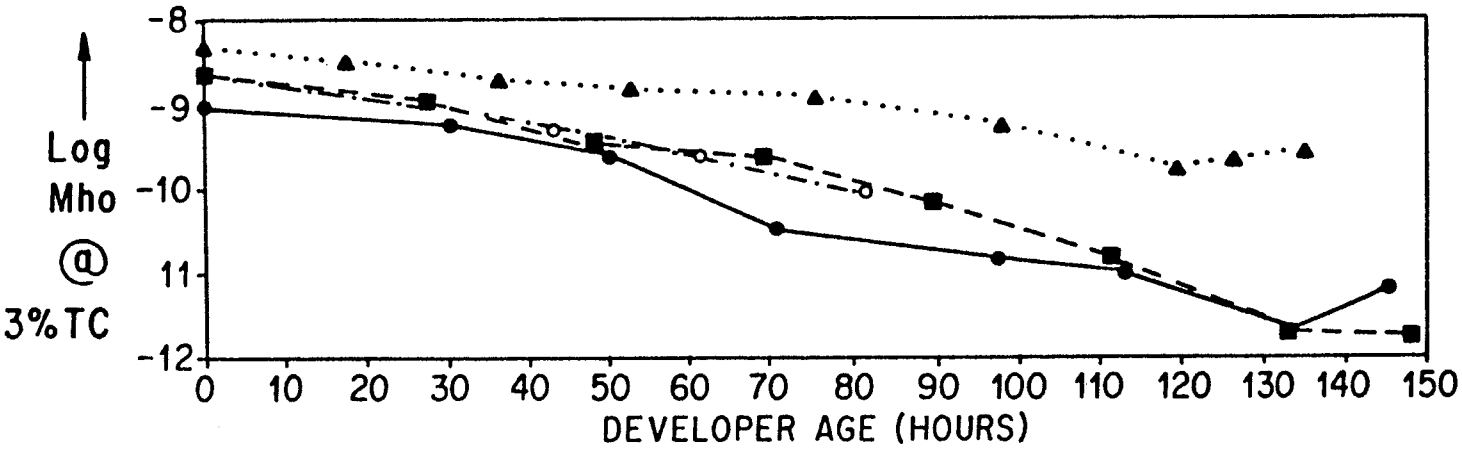
FIG. 1 illustrates a graph of the log of the conductivity of developer compositions versus developer age.

The present invention is directed to toner compositions comprising from about 0.35% to about 0.65%, preferably from about 0.40% to about 0.60% by weight of at least one pyridinium compound or its hydrate and from about 1% to about 2%, preferably from about 1.3% to about 1.8% by weight of at least one tetrasubstituted ammonium salt. These toner compositions are environmentally friendly as they have a $LC_{50}$ of about 500 mg/l to about 1000 mg/l, typically about 700 mg/l to about 750 mg/l. The toner compositions of the present invention have conductivity ranges of about $10^{-7}$ to about $10^{-12}$ ohm-cm, preferably about $10^{-7}$ to about $10^{-10}$ ohm-cm. These conductivity ranges remain at acceptable levels throughout the life of the toner composition. These formulations can be run in a copier which can generate 90 copies per minute to a total of about 500,000 copies with performance equal to or better than other formulations containing alkyl pyridinium compounds warranted for about 300,000 copies such as formulations containing about 2% by weight of cetyl pyridinium chloride, about 6% by weight of carbon black and about 92% by weight styrene n-butyl methacrylate copolymer. Moreover, the toner compositions of the present invention are more compatible with Viton fuser rolls as the above described effects of these toner compositions on the fuser rolls are considerably reduced compared to other toner compositions containing like charge enhancing additives.

Preferred pyridinium compounds or hydrates which can be employed to practice this invention have the following formula:

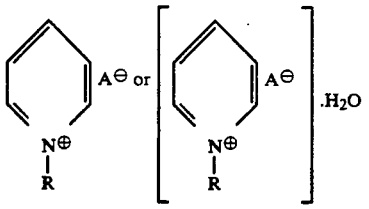

wherein $A^-$ is an anion which may, for example, be selected from halides, such as chlorine, bromine, iodine and fluorine, sulfates, sulfonates, nitrates and borates; and R is a hydrocarbon radical containing from 8 to 22 carbon atoms, preferably from 12 to 18 carbon atoms. Illustrative examples of such hydrocarbon radicals include octyl, nonyl, myristyl, cetyl, olely, pentadecyl, heptadecyl and octadecyl.

Illustrative examples of alkyl pyridinium compounds useful in the present invention include but are not limited to cetyl pyridinium chloride, heptadecyl pyridinium bromide, octadecyl pyridinium chloride, myristyl pyridinium chloride, and the like, as well as their corresponding hydrates.

A second charge enhancing additive employed in this invention is at least one tetrasubstituted ammonium salt. These include, but are not limited to, quaternary ammonium sulfates. Examples of the quaternary ammonium sulfates which can be employed include, but are not limited to, distearyl dimethyl ammonium methyl sulfate and behenyl trimethyl ammonium methyl sulfate. These tetrasubstituted ammonium salts are known compositions of matter and can be prepared by any suitable method known in the art. One such method is disclosed in U.S. Pat. No. 4,560,635, the entire disclosure of which is hereby incorporated herein by reference.

Other suitable tetrasubstituted ammonium salts include, but are not limited to, tetraalkyl ammonium bisulfates which can be represented by the formula $R'_2N^+R''_2X^-$ wherein R' is an alkyl with from 1 to 30, preferably from 1 to 20, carbon atoms, such as methyl, ethyl, propyl, butyl, hexyl, heptyl, octyl, nonyl, decyl, stearyl and the like; R" is an alkyl with from 1 to 10 carbon salts, preferably from 1 to 8 carbon atoms, such as methyl, ethyl, propyl, butyl, hexyl, heptyl, octyl and the like; and $X^-$ is an anion of bisulfate ($HSO_4^-$).

Other suitable charge enhancing additives include tetralkyl ammonium sulfonates represented by the following formula $R'_2N^+R_2''X^-$ wherein R' is alkyl with from 1 to 30 carbon atoms, preferably from 1 to 20 carbon atoms, such as methyl, ethyl, propyl, butyl, hexyl, heptyl, octyl, nonyl, decyl, stearyl and the like; R" is alkyl with from 1 to 10 carbon atoms, preferably from 1 to 8 carbon atoms such as methyl, ethyl, propyl, butyl, hexyl, heptyl, octyl and the like; and $X^-$ is an anion derived from a sulfonic acid ($RSO_3^-$). Anion examples include $CH_3SO_3^-$, $CF_3SO_3^-$, $RSO_3^-$, wherein R is alkyl or perfluoroalkyl that, for example, contains at least two carbon atoms, and the like.

Other suitable charge enhancing additives include tetraalkyl ammonium halides where $X^-$ of the above formula is an ion derived from chlorine, bromine, fluorine or iodine.

Examples of specific bisulfate charge enhancing additives include, but are not limited to, tetraalkyl ammonium bisulfates such as distearyl dimethyl ammonium bisulfate, methyl ammonium bisulfate, tetraethyl ammonium bisulfate, tetrabutyl ammonium bisulfate, dioctyl dimethyl ammonium bisulfate, didodecyl dimethyl ammonium bisulfate, dihexydecyl dimethyl ammonium bisulfate and the like, preferably distearyl methyl hydrogen ammonium bisulfate. Examples of tetraalkyl ammonium sulfonate charge additives include, but are not limited to distearyl dimethyl ammonium methyl sulfonate, trifluoromethyl sulfonate, tetramethyl ammonium methyl sulfonate, tetramethyl ammonium trifluoromethyl sulfonate, tetrabutyl ammonium methyl sulfonate, tetrabutyl ammonium trifluoromethyl sulfonate, dioctyl dimethyl ammonium methyl sulfonate, dioctyl dimethyl ammonium trifluoromethyl sulfonate, didodecyl dimethyl ammonium methyl sulfonate, didodecyl dimethyl ammonium trifluoromethyl sulfonate, dihexadecyl dimethyl ammonium methyl sulfonate, dihexadecyl dimethyl ammonium trifluoromethyl sulfonate, and the like, preferably distearyl dimethyl trifluoromethyl sulfonate. Examples of tetraalkyl ammonium halides include, but are not limited to, distearyl dimethyl ammonium chloride and distearyl dimethyl ammonium bromide.

Tetraalkyl ammonium bisulfates, tetraalkyl ammonium alkyl sulfonates and tetraalkyl ammonium halides can be prepared by any suitable method known in the art.

Toner and developer compositions of the present invention can be prepared by a number of known methods. The toner compositions may be prepared by such methods as admixing and heating resin such as styrene butadiene copolymers, optional colorant such as pigment particles such as magnetite, carbon black, or mixtures thereof, and the aforementioned mixtures of charge enhancing additives, in a toner extrusion device, such as the ZSK53 available from Werner & Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably from about 8 to about 13 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Developer compositions may be prepared by extrusion melt blending the toner composition with a suitable carrier component and other suitable components followed by mechanical attritions and classification. Other methods include those well known in the art such as spray drying, melt dispersion, extrusion processing, dispersion polymerization and suspension polymerization.

Illustrative examples of suitable toner resins selected for the toner and developer compositions of the present invention include polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, saturated mono-olefins such as ethylene, propylene, butylene, isobutylene and the like; unsaturated monoolefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof; and the like; styrene butadiene copolymers with a styrene content of from about 75 to about 95 weight percent. In addition, crosslinked resins, including polymers, copolymers, and homopolymers of the aforementioned polymers may be selected. Generally, the resin content of the toner composition comprises from about 80% to about 95% by weight of the composition, preferably from about 85% to about 92% by weight of the composition.

Examples of specific toner resins are the esterification products of a dicarboxylic acid and a diol comprising a diphenol. These resins are illustrated in U.S. Pat. No. 3,590,000, the entire disclosure of which is hereby incorporated herein by reference. Other specific toner resins include styrene/methacrylate copolymers, and styrene/butadiene copolymers; Pliolites; suspension polymerized styrene butadienes as described in U.S. Pat. No. 4,558,108, the entire disclosure of which is hereby incorporated herein by reference; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, and pentaerythritol; styrene acrylates, and mixtures thereof.

Waxes with a molecular weight of from about 1,000 to about 6,000, such as polyethylene, polypropylene, UNILIN TM hydroxy alcohols and paraffin waxes can be included in or on the toner compositions as fuser roll release agents. The low molecular weight wax materials may be present in the toner composition of the present invention in various amounts; however, generally these waxes are present in an amount of from about 1 percent by weight to about 10 percent by weight, preferably in an amount of from about 3 percent by weight to about 6 percent by weight of the toner composition.

Numerous well known suitable pigments or dyes can be selected as the colorant for the toner particles including, for example, carbon black, such as Regal® 330, nigrosine dye, aniline blue, magnetite, or mixtures thereof. Colorant may preferably be present in a sufficient amount to render the toner composition highly colored. Generally, the pigment particles are present in amounts of from about 1 percent by weight to about 15 percent by weight, preferably from about 4 to about 6 weight percent based on the total weight of the toner composition.

When the pigment particles are comprised of magnetites, thereby enabling single component toners in some instances, the magnetites are preferably a mixture of iron oxides ($FeO.Fe_2O_3$) including those commercially available as Mapico Black. Such particles are preferably present in such toner compositions in an amount of from about 10 percent by weight to about 30 percent by weight, preferably in an amount of from about 10 percent by weight to about 15 percent by weight.

Encompassed within the scope of the present invention are colored toner compositions comprised of toner resin particles, the combination of charge enhancing additives illustrated herein, and as pigments or colorants, red, blue, green, brown, magenta, cyan and/or yellow particles, as well as mixtures thereof. Illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthracene Blue, identified in the Color Index as CI 69810, Special Blue X-2137, and the like; illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments may be incorporated into the toner composition in various suitable effective amounts.

There can also be blended with the toner compositions of the present invention external additive particles including flow aid additives, which additives are usually present on the surface of the toner particles, but may be mixed thereinto. Examples of these additives include colloidal silicas such as Aerosil, metal salts and metal salts of fatty acids inclusive of zinc stearate, aluminum oxides, cerium oxides, and mixtures thereof. Such additives are generally present in an amount of from about 0.1 percent by weight to about 5 percent by weight, preferably in an amount of from about 0.1 percent by weight to about 1 percent by weight. Several of the aforementioned additives are illustrated in U.S. Pat. Nos. 3,590,000 and 3,800,588, the entire disclosures of which are hereby incorporated herein by reference.

For the formulation of developer compositions, there may be mixed with the toner particles carrier components, particularly those capable of triboelectrically assuming an opposite polarity to that of the toner composition. Accordingly, carrier particles of the present invention can be selected to be of a negative polarity enabling the toner particles, which are positively charged, to adhere to and surround the carrier particles. Illustrative examples of carrier particles include iron powder, steel, nickel, iron ferrites, copper zinc ferrites, and the like. Additionally, there can be selected as carrier particles nickel berry carriers as illustrated in U.S. Pat. No. 3,847,604, the entire disclosure of which is hereby incorporated herein by reference. The selected carrier particles can be used with or without a coating, the coating generally containing terpolymers of styrene, methylmethacrylate, and a silane, such as triethoxy silane as described in U.S. Pat. Nos. 3,526,533 and 3,467,634, the entire disclosures of which are hereby incorporated herein by reference; polymethyl methacrylates; other known coatings in the art; and the like. The carrier particles may also include in the coating from about 566 0.01 to about 3 weight percent of a conductive substance, such as carbon black. Other polymer coatings which can be employed include but are not limited to those described in U.S. Pat. Nos. 4,937,166 and 4,935,326, the entire disclosures of which are hereby incorporated herein by reference, including for example Kynar and polymethyl methacrylate mixtures (40/60). Coating weights can vary from about 0.05 to about 2, preferably from about 0.1 to about 1.0, weight percent.

Furthermore, the diameter of the carrier particles, preferably spherical in shape, is generally from about 50 microns to about 1,000 microns, thereby permitting them to possess sufficient density and inertia to avoid adherence to electrostatic images during development. The carrier component can be mixed with the toner composition in various suitable combinations such as from about 1 to 5 parts of toner to about 100 parts by weight of carrier.

The toner and developer compositions of the present invention may be selected for use in electrostatographic imaging apparatuses containing therein conventional photoreceptors. Thus, the toner and developer compositions of the present invention can be used with layered photoreceptors such as those described in U.S. Pat. No. 4,265,990, the entire disclosure of which is hereby incorporated herein by reference. Illustrative examples of inorganic photoreceptors that may be selected for imaging and printing processes include those comprising selenium; selenium alloys, such as selenium arsenic, selenium tellurium and the like; halogen doped selenium substances; and halogen doped selenium alloys. Other similar photoreceptors can be selected.

Organic photoresponsive devices useful in the present invention include those comprising polyvinylcarbazole 4-dimethylaminobenzylidene, benzhydrazide; 2-benzylidene-amino-carbazole; 4-dimethamino-benzylidene; (2-nitrobenzylidene)-p-bromoaniline; 2,4-diphenylquinazoline; 1,2,4-triazine; 1,5-diphenyl-3-methyl pyrazoline 2-(4'-dimethyl-amino phenyl)benzoazole; 3-amino-carbazole; polyvinyl carbazole-trinitrofluorenone charge transfer complex; and mixtures thereof.

The toner compositions of the present invention possess a triboelectric charge of from about 0.1 to about 2 femtocoulombs per micron as determined by charge spectrograph. Admix time for the toners of the present invention are equal to about 15 seconds to about 1 minute, more specifically from about 15 to about 30 seconds. Admix time is the rate of charge for the toner added to a developer housing. The faster the admix time the more desirable as the amount of newly charged toner can replace used charged toner during printing at a faster rate. These toner compositions with rapid admix characteristics enable, for example, the development of images in electrophotographic imaging apparatuses, which images have substantially no background deposits thereon, even at high toner dispensing rates, for example exceeding 20 grams per minute; and further, such toner compositions can be selected for high speed electrophotographic apparatuses, that is those exceeding 70 copies per minute.

Figure 2:
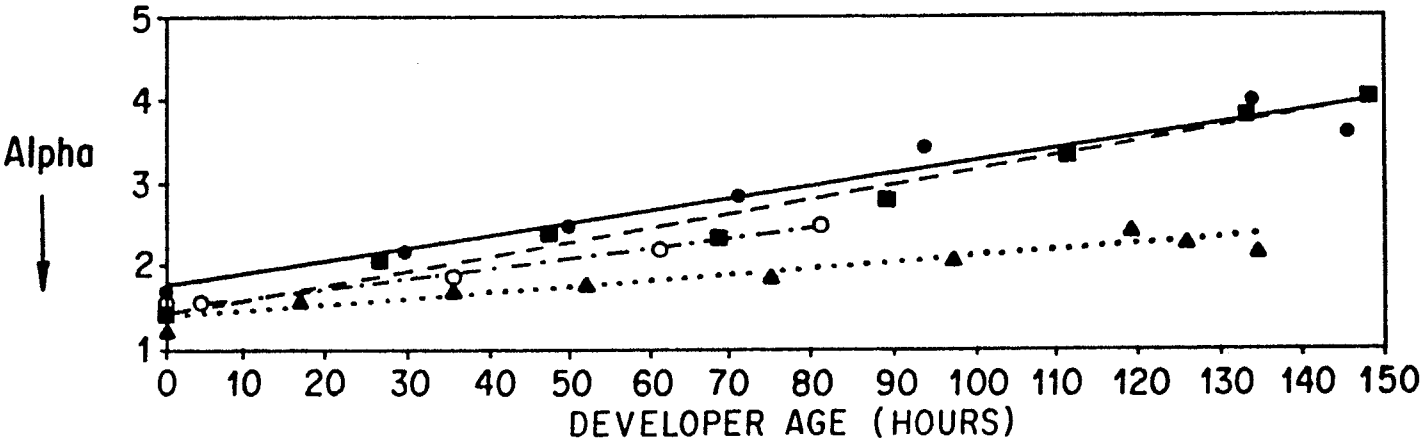
FIG. 2 illustrates a graph of the alpha values of developer compositions versus developer age.
Figure 3:
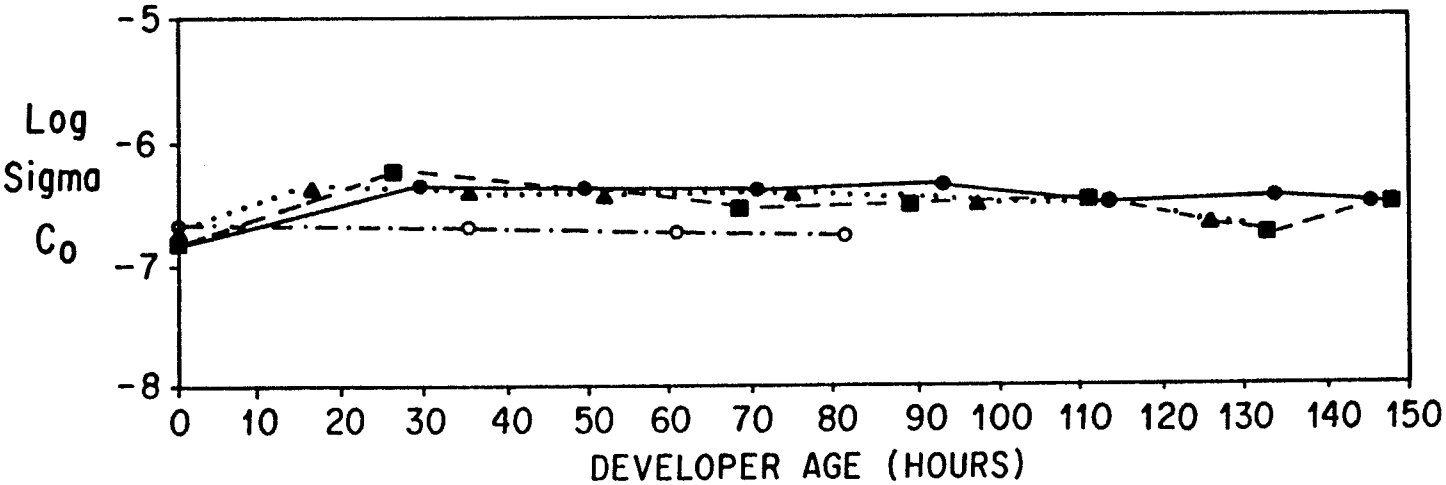
FIG. 3 illustrates a graph of the log of the sigma concentration of developer compositions versus developer age.

Table 1 below illustrate the plots as shown in FIGS. 1-3 of developer compositions prepared in the Examples I-IV below.

TABLE 1

| | |
|---|---|
| EXAMPLE I | ●——● |
| EXAMPLE II | ■– – –■ |
| EXAMPLE III | ▲· · · ·▲ |
| EXAMPLE IV | ○·–·○ |

EXAMPLE I

Control Developer

A toner composition is prepared in an extrusion device, available as ZSK53 from Werner Pfleiderer, by adding thereto about 92% by weight of suspension polymerized styrene/n-butyl methacrylate copolymer resin particles (87/13); about 6% by weight of Regal® 330 carbon black; and about 2% by weight of charge enhancing additive cetyl pyridinium chloride. The toner composition is extruded at a rate of about 15 pounds per hour reaching a temperature of about 410° F. The strands of melt mixed product exiting from the extruder are cooled by immersing them in a water bath maintained at a temperature of about 25° C. Subsequent to air drying, the resulting toner is subjected to grinding in a Sturtevant micronizer enabling particles with a volume median diameter of from about 8 to 12 microns as measured by a Coulter counter. Thereafter, the toner particles are classified in a Donaldson Model B classifier for purposes of removing fine particles, that is those with a volume median diameter of less than about 4 microns.

Subsequently, the above formulated toner, about 3 parts by weight, is mixed with about 97 parts by weight of a carrier containing a steel core with about 0.70% by weight of a polymer mixture thereon, which polymer mixture contains about 50 parts by weight of polyvinylidene fluoride in about 50 parts by weight of polymethyl methacrylate. Mixing is accomplished in a paint shaker for about 10 minutes. There results a developer composition having a conductivity of about $10^{-14}$ ohm-cm.

EXAMPLE II

A toner composition is prepared in an extrusion device, available as ZSK53 from Werner Pfleiderer, by adding thereto about 92% by weight of suspension polymerized styrene/n-butyl methacrylate copolymer resin particles (87/13); about 6.5% by weight of Regal®330 carbon black; about 0.5% by weight cetyl pyridinium chloride; and about 1% by weight distearyl dimethyl ammonium methyl sulfate. The toner product is extruded at a rate of about 15 pounds per hour reaching a melting temperature of about 410° F. Strands of melt mixed product exiting from the extruder are cooled by immersing them in a water bath maintained at a temperature of about 25° C. Subsequent to air drying, the resulting toner is subjected to grinding in a Sturtevant micronizer enabling particles with a volume median diameter of from about 8 to 12 microns as measured by a Coulter counter. Thereafter, the toner particles are classified in a Donaldson Model B classifier for purposes of removing fine particles, that is those with a volume median diameter of less than about 4 microns.

Subsequently, the above formulated toner, about 3 parts by weight, is mixed with about 97 parts by weight of a carrier containing a steel core with about 0.70% by weight of a polymer mixture thereon, which polymer mixture contains about 50 parts by weight of polyvinylidene fluoride and about 50 parts by weight of polymethyl methacrylate, by mixing in a paint shaker for about 10 minutes. The resulting developer composition has a conductivity of about $10^{-10}$ ohm-cm.

EXAMPLE III

A developer composition is prepared as described in Example II except that the toner composition comprises about 91.5% by weight styrene/n-butyl methacrylate; about 6.0% by weight of Regal® 330 carbon black; about 0.5% by weight cetyl pyridinium chloride; and about 2% by weight distearyl dimethyl ammonium methyl sulfate. The toner composition has a conductivity of about $10^{-7}$ ohm-cm.

EXAMPLE IV

A toner composition is prepared according to the method of Example II, except that the toner composition comprises about 92% by weight styrene/n-butyl methacrylate; about 6.0% by weight Regal® 330 carbon black; about 0.5% by weight cetyl pyridinium chloride and about 1.5% by weight of distearyl dimethyl ammonium methyl sulfate. The toner composition has a conductivity of about $10^{-12}$ ohm-cm.

EXAMPLE V

The conductivity of each of the developer compositions prepared in Examples I–IV is measured over a period of time to determine their conductivity. The conductivity of a 3% test preparation for each developer composition is measured on a magnetic brush developer housing which is modified by a person of skill in the art by adding electrodes to measure toner voltage. Eight samples are tested from each composition except for the developer in Example IV in which four samples are tested.

Table 2 below shows the results for the developer prepared according to Example I. Table 3 shows the results for the composition prepared in Example II and Tables 4 and 5 show the results from the tests performed on developers prepared in Examples III and IV, respectively.

TABLE 2

| Developer Age (Hrs) | Log Conductivity @ 3% TC | Alpha | Log Sigma $C_0$ |
|---|---|---|---|
| 0 | −9.03 | 1.69 | −6.83 |
| 29.7 | −9.20 | 2.21 | −6.31 |
| 49.7 | −9.56 | 2.47 | −6.33 |
| 71 | −10.44 | 2.86 | −6.36 |
| 97.5 | −10.80 | 3.43 | −6.34 |
| 113.2 | −10.99 | 3.43 | −6.53 |
| 133.7 | −11.66 | 3.97 | −6.48 |
| 145.5 | −11.17 | 3.57 | −6.53 |

TABLE 3

| Developer Age (Hrs) | Log Conductivity @ 3% TC | Alpha | Log Sigma $C_0$ |
|---|---|---|---|
| 0 | −8.64 | 1.41 | −6.81 |
| 26.7 | −8.92 | 2.08 | −6.21 |
| 47.1 | −9.45 | 2.42 | −6.30 |
| 68.6 | −9.60 | 2.36 | −6.51 |
| 89 | −10.12 | 2.78 | −6.49 |
| 111 | −10.78 | 3.30 | −6.48 |
| 132.8 | −11.72 | 3.80 | −6.77 |
| 147.8 | −11.76 | 4.02 | −6.53 |

TABLE 4

| Developer Age (Hrs) | Log Conductivity @ 3% TC | Alpha | Log Sigma $C_0$ |
|---|---|---|---|
| 0 | −8.31 | 1.24 | −6.70 |
| 16.8 | −8.46 | 1.64 | −6.32 |
| 35.6 | −8.66 | 1.76 | −6.37 |
| 52.0 | −8.76 | 1.81 | −6.39 |
| 75.0 | −8.85 | 1.90 | −6.38 |
| 97.3 | −9.22 | 2.10 | −6.48 |
| 119.0 | −9.71 | 2.41 | −6.57 |
| 126.0 | −9.63 | 2.28 | −6.67 |
| 134.4 | −9.53 | 2.15 | −6.73 |

TABLE 5

| Developer Age (Hrs) | Log Conductivity @ 3% TC | Alpha | Log Sigma $C_0$ |
|---|---|---|---|
| 0 | −8.64 | 1.53 | −6.64 |
| 35.4 | −9.11 | 1.88 | −6.65 |
| 61.0 | −9.59 | 2.22 | −6.68 |
| 81.2 | −10.04 | 2.52 | −6.73 |

The values obtained for each developer composition were plotted on separate graphs (FIGS. 1, 2 and 3) to illustrate the improved conductivity performance of the developer compositions of the present invention.

FIG. 1 illustrates improved conductivity of the developer compositions of the present invention over the control composition. The developer of Example III shows the best conductivity performance over time.

FIG. 2 illustrates improved alpha values of the developers of the present invention versus the control. Alpha value is a measure of the sensitivity of developer conductivity to changes in toner concentration described by the following equation: $\sigma=\sigma_0{}^{-\alpha TC}$ where TC is toner concentration and $\sigma_0$ is conductivity of the developer when the toner concentration equals 0 and $\alpha$ is a measure of the sensitivity of developer conductivity to changes in toner concentration. The lower alpha values of the developers of the present invention show a lesser change in conductivity to change in toner concentration over time versus the control, thus showing improved developer preparations.

FIG. 3 illustrates the log of $\sigma C_0$ which is a measure of the conductivity of a carrier after the carrier is exposed to a toner composition and the toner composition is removed from the carrier. The plot shows that the log of $\sigma C_0$ for the test samples of Examples II–IV is not significantly different than the control samples of Example I. This shows that the improved conductivity and alpha values of the developer composition of the present invention are the result of the toner formulations, not the carrier employed in the developer compositions.

Figure 4:
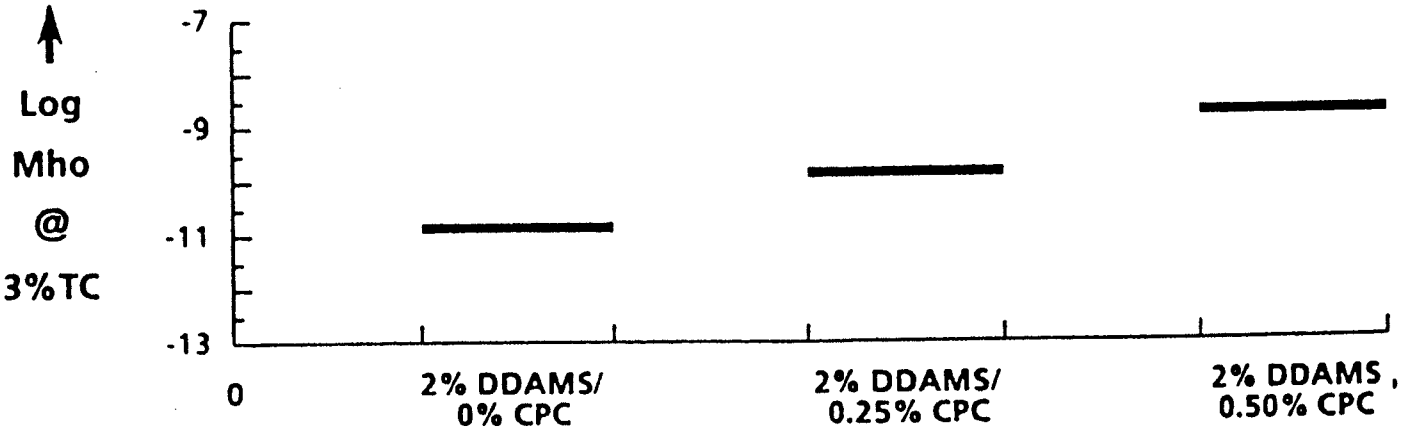
FIG. 4 illustrates a graph of the log of the conductivity of developer compositions versus composition of charge enhancing additives.
Figure 5:
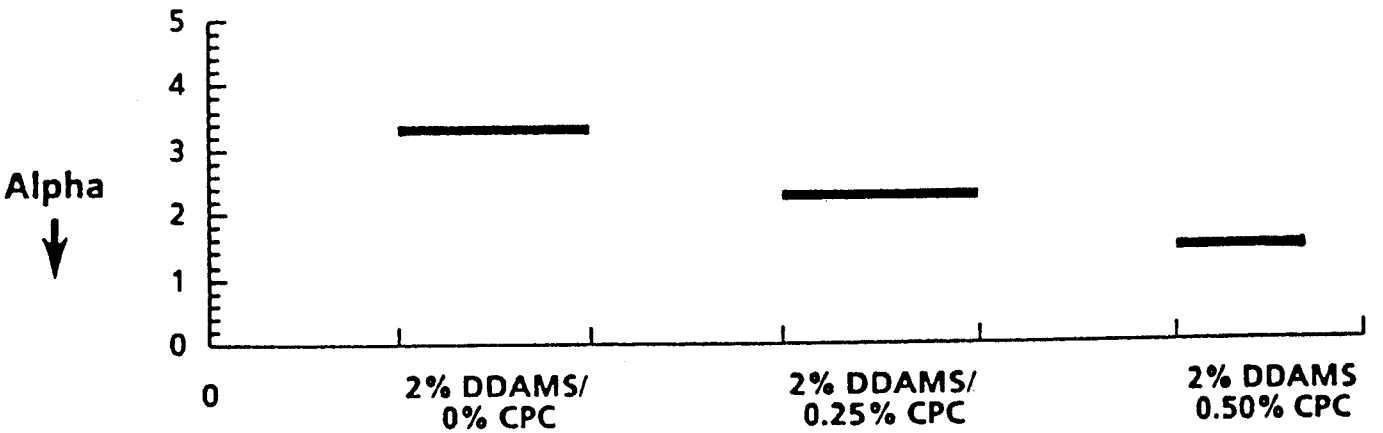
FIG. 5 illustrates a graph of alpha values of developer compositions versus composition of charge enhancing additives.
Figure 6:
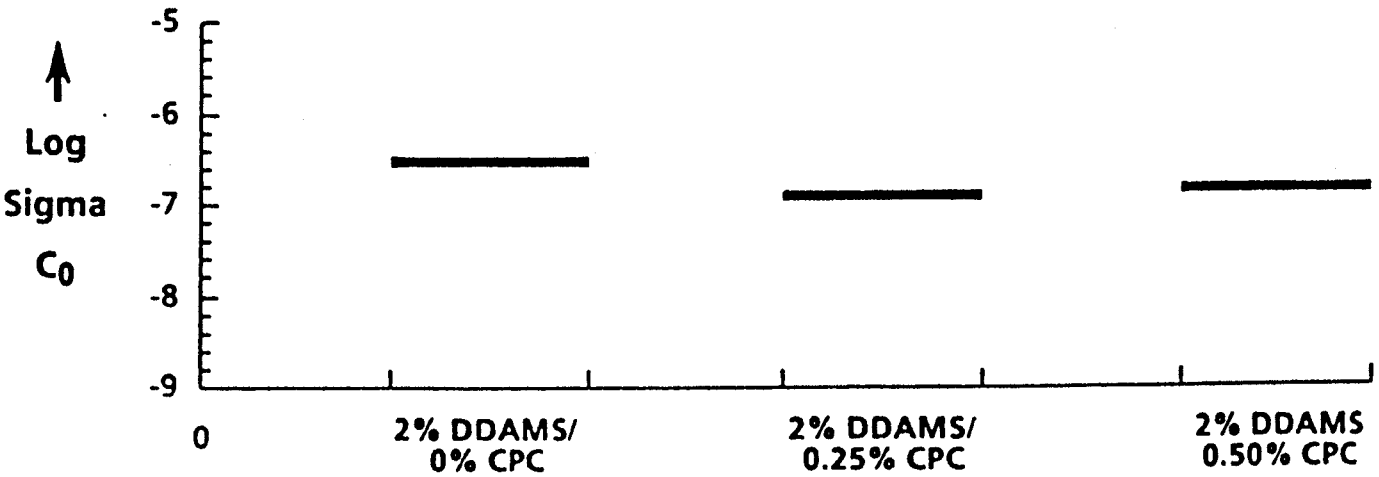
FIG. 6 illustrates a graph of the log of the sigma concentration of developer compositions versus composition of charge enhancing additives.

FIGS. 4, 5 and 6 contrast the conductivities, alpha values and log of $\sigma C_0$ of developer compositions of the present invention versus the conductivities, alpha values and log of $\sigma C_0$ of a developer composition containing a toner formulation of about 2% by weight of charge enhancing additive distearyl dimethyl ammonium methyl sulfate; 92% by weight of suspension polymerized styrene/n-butyl methacrylate copolymer resin particles (87/13); and about 6% by weight of Regal® 330 carbon black. This developer composition is prepared according to the method disclosed in Example I.

The developer compositions containing 2% by weight of distearyl dimethyl ammonium methyl sulfate and 0.25% by weight of cetyl pyridinium chloride or 0.5% by weight of cetyl pyridinium chloride are prepared according to the method described in Example II. The conductivities, alpha values and log of $\sigma C_0$ are determined as in Example V except five test samples for each composition are tested. The average of the conductivity, alpha value and log of $\sigma C_0$ for each developer composition tested is contrasted in FIGS. 4, 5 and 6.

FIGS. 4 and 5 show improved conductivity and alpha values, respectively, of the developer compositions of the present invention over the control developer compositions containing distearyl dimethyl ammonium methyl sulfate without cetyl pyridinium chloride.

FIG. 6 shows the log of $\sigma C_0$ almost identical for the three kinds of developer tested. Consequently, the improved properties of the developer compositions of the present invention are due to the toner formulations, not the carrier material employed.

What is claimed is:

1. A toner comprising a toner resin and from about 0.35% to about 0.65% by weight of at least one pyridinium compound or its hydrate and from about i% to about 2% by weight of at least one tetrasubstituted ammonium salt.

2. The toner of claim 1, comprising from about 0.40% to about 0.60% by weight of the pyridinium compound or its hydrate and from about 1.3% to about 18% by weight of the tetrasubstituted ammonium salt.

3. The toner of claim 1, wherein the pyridinium compound or its hydrate has the following formula:

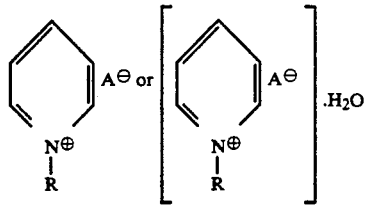

wherein R is a hydrocarbon radical comprising from 8 to 22 carbon atoms and A− comprises a chloride, bromide, fluoride, iodide, sulfate, sulfonate, nitrate or borate group.

4. The toner of claim 2, wherein the pyridinium compound is at least one member selected from the group consisting of cetyl pyridinium chloride, heptadecyl pyridinium bromide, octadecyl pyridinium chloride, myristyl pyridinium chloride and their corresponding hydrates.

5. The toner of claim 1, wherein the tetrasubstituted ammonium salt is at least one member selected from the group consisting of a quaternary ammonium sulfate, a tetraalkyl ammonium bisulfate, a tetraalkyl ammonium sulfonate and a tetraalkyl ammonium halide.

6. The toner of claim 5, wherein the quaternary ammonium sulfate is at least one member selected from the group consisting of distearyl dimethyl ammonium methyl sulfate and behenyl trimethyl ammonium methyl sulfate.

7. The toner of claim 5, wherein the tetraalkyl ammonium bisulfate has the following formula:

$$R'_2N^+R''_2X^-$$

wherein R′ is an alkyl having from to 30 carbon atoms; R″ is an alkyl having from 1 to 10 carbon atoms and X− is a bisulfate ($HSO_4^-$).

8. The toner of claim 5, wherein the tetraalkyl ammonium bisulfate is at least one member selected from the group consisting of tetraalkyl ammonium bisulfate, distearyl dimethyl ammonium bisulfate, tetramethyl ammonium bisulfate, tetraethyl ammonium bisulfate, tetrabutyl ammonium bisulfate, dioctyl dimethyl ammonium bisulfate, didodecyl dimethyl ammonium bisulfate and dihexadecyl dimethyl ammonium bisulfate.

9. The toner of claim 5, wherein the tetraalkyl ammonium sulfonate has the following formula:

$$R'_2N^+R''_2X^-$$

wherein R′ is alkyl having from 1 to 30 carbon atoms; R is an alkyl having from 1 to 10 carbon atoms and X− is an anion derived from a sulfonic acid $RSO_3^-$ wherein R is an alkyl or perfluoralkyl comprising at least two carbon atoms.

10. The toner of claim 5, wherein the tetraalkyl ammonium sulfonate is at least one member selected from the group consisting of distearyl dimethyl ammonium methyl sulfonate, trifluoromethyl sulfonate, tetramethyl ammonium methyl sulfonate, tetramethyl ammonium trifluoromethyl sulfonate, tetrabutyl ammonium methyl sulfonate, tetrabutyl ammonium trifluoromethyl sulfonate, dioctyl dimethyl ammonium methyl sulfonate, dioctyl dimethyl ammonium trifluoromethyl sulfonate, didodecyl dimethyl ammonium methyl sulfonate, didodecyl dimethyl ammonium trifluoromethyl sulfonate, dihexadecyl dimethyl ammonium methyl sulfonate, dihexadecyl dimethyl ammonium trifluoromethyl sulfonate.

11. The toner of claim 5, wherein the tetraalkyl ammonium halide has the following formula:

$$R'_2N^+R''_2X^-$$

wherein R' is an alkyl having from 1 to 30 carbon atoms; R' is an alkyl having from 1 to 10 carbon atoms; and X is a chloride, bromide, fluoride or iodide group.

12. The toner of claim 1, wherein the pyridinium compound is cetyl pyridinium chloride and the tetrasubstituted ammonium salt is distearyl dimethyl ammonium methyl sulfate.

13. The toner of claim 1, wherein the pyridinium compound is cetyl pyridinium chloride and the tetrasubstituted ammonium salt is distearyl dimethyl ammonium chloride.

14. The toner of claim 1, wherein the pyridinium compound is cetyl pyridinium chloride and the tetrasubstituted ammonium salt is distearyl dimethyl bisulfate.

15. The toner of claim 1, wherein the toner resin comprises from about 80% to about 95% by weight of the toner composition.

16. The toner of claim 1, further comprising a colorant.

17. The toner of claim 1, further comprising at least one wax.

18. The toner of claim 17, wherein the wax is present in an amount from about 1% to about 10% by weight of the composition.

19. A developer comprised of the toner of claim 1 and a carrier.

20. The developer of claim 19, wherein the pyridinium compound is at least one member selected from the group consisting of cetyl pyridinium chloride, heptadecyl pyridinium bromide, octadecyl pyridinium chloride, myristyl pyridinium chloride and their corresponding hydrates.

21. The developer of claim 19, wherein the tetrasubstituted ammonium salt is at least one member selected from the group consisting of a quaternary ammonium sulfate, a quaternary ammonium bisulfate, a tetraalkyl ammonium sulfonate and a tetraalkyl ammonium halide.

22. A developer of claim 21, wherein the quaternary ammonium sulfate is at least one member selected from the group consisting of distearyl dimethyl ammonium methyl sulfate and behenyl trimethyl ammonium methyl sulfate.

23. The developer of claim 19, further comprising a colorant.

24. The developer of claim 19, wherein the carrier comprises particles selected from the group consisting of iron, steel, nickel and zinc.

25. The developer of claim 19, wherein the developer has a conductivity of about $10^{-7}$ ohm-cm to about $10^{12}$ ohm-cm.

26. A method of developing an image comprising forming an electrostatic latent image on a photoconductive imaging member, contacting the latent image with a toner comprising from about 0.35% to about 0.65% by weight of a pyridinium compound or its hydrate, from about 1% to about 2% by weight of a tetrasubstituted ammonium salt, a resin and a colorant, to form a toner image, followed by transferring the toner image to a suitable substrate and affixing the toner image thereto.

27. The method of claim 26, wherein the pyridinium compound is selected from the group consisting of cetyl pyridinium chloride, heptadecyl pyridinium bromide, octadecyl pyridinium chloride and myristyl pyridinium chloride.

28. The method of claim 26, wherein the tetrasubstituted ammonium salt is at least one member selected from the group consisting of a quaternary ammonium sulfate, a tetraalkyl ammonium bisulfate, a tetraalkyl ammonium sulfonate and a tetraalkyl ammonium halide.

29. The method of claim 28, wherein the quaternary ammonium sulfate is at least one member selected from the group consisting of distearyl dimethyl ammonium methyl sulfate and behenyl trimethyl ammonium methyl sulfate.

30. The toner of claim 1, wherein the toner resin is selected from the group consisting of polyamides, polydiefins, styrene acrylates, styrene methacrylates, styrene butadienes, and polymeric esterification products of a dicarboxylic acid and a diol comprising a diphenyl.

31. The method of claim 26, wherein the resin is selected from the group consisting of styrene acrylates, styrene methacrylates, styrene butadienes and polymeric esterification products of a dicarboxylic acid and a diol comprising a diphenyl.

* * * * *

UNITED STATES PATENT AND TRADEMARK OFFICE

CERTIFICATE OF CORRECTION

PATENT NO. : 5,304,449

DATED : April 19, 1994

INVENTOR(S) : William H. HOLLENBAUGH, Jr.

It is certified that error appears in the above-indentified patent and that said Letters Patent is hereby corrected as shown below:

Col. 11, line 65, claim 2, change "18%" to --1.8%--

Signed and Sealed this

Twenty-fifth Day of August, 1998

Bruce Lehman

*Attest:*

BRUCE LEHMAN

*Attesting Officer*

*Commissioner of Patents and Trademarks*